US009735471B2

(12) United States Patent
Liou et al.

(10) Patent No.: US 9,735,471 B2
(45) Date of Patent: Aug. 15, 2017

(54) ANTENNA STRUCTURE AND WIRELESS COMMUNICATION DEVICE EMPLOYING SAME

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 84 days.

(21) Appl. No.: 14/471,304

(22) Filed: Aug. 28, 2014

(65) Prior Publication Data

US 2015/0061960 A1 Mar. 5, 2015

(30) Foreign Application Priority Data

Aug. 30, 2013 (CN) ..... 2013 1 03858768

(51) Int. Cl.
*H01Q 1/38* (2006.01)
*H01Q 5/378* (2015.01)
*H01Q 5/335* (2015.01)

(52) U.S. Cl.
CPC ..... *H01Q 5/378* (2015.01); *H01Q 5/335* (2015.01)

(58) Field of Classification Search
CPC ..... H01Q 1/38; H01Q 1/243
USPC ..... 343/700 MS
See application file for complete search history.

(56) References Cited

U.S. PATENT DOCUMENTS

2016/0351998 A1* 12/2016 Ahn ..... H01Q 9/0414

* cited by examiner

*Primary Examiner* — Graham Smith
(74) *Attorney, Agent, or Firm* — Steven Reiss

(57) ABSTRACT

An antenna structure includes a monopole antenna, a short parasitic antenna and an impedance matching circuit. The monopole antenna includes a first radiating body, a second radiating body and a feeding portion coupled to the first radiating body and the second radiating body. The first radiating body configured to excite a low-frequency resonating mode; the second radiating body configured to excite a first high-frequency resonating mode. The short parasitic antenna includes a parasitic body spaced apart from the second radiating body and a grounding portion coupled to the parasitic body. The short parasitic antenna configured to excite a second high-frequency resonating mode, and resonate with the second radiating body to excite a third high-frequency resonating mode. The impedance matching circuit includes a variable capacitor configured to regulate operating frequency band of the low-frequency resonating mode.

7 Claims, 7 Drawing Sheets

ANTENNA STRUCTURE AND WIRELESS COMMUNICATION DEVICE EMPLOYING SAME

FIELD

The subject matter herein generally relates to antenna structures, and particular to an multiband antenna structure and a wireless communication device employing same.

BACKGROUND

With improvements in the integration of wireless communication systems, antennas have become increasingly important. For a wireless communication device to utilize various frequency bandwidths, antennas having wider bandwidth have become a significant technology.

BRIEF DESCRIPTION OF THE DRAWINGS

Implementations of the present technology will now be described, by way of example only, with reference to the attached figures.

DETAILED DESCRIPTION

Figure 1:
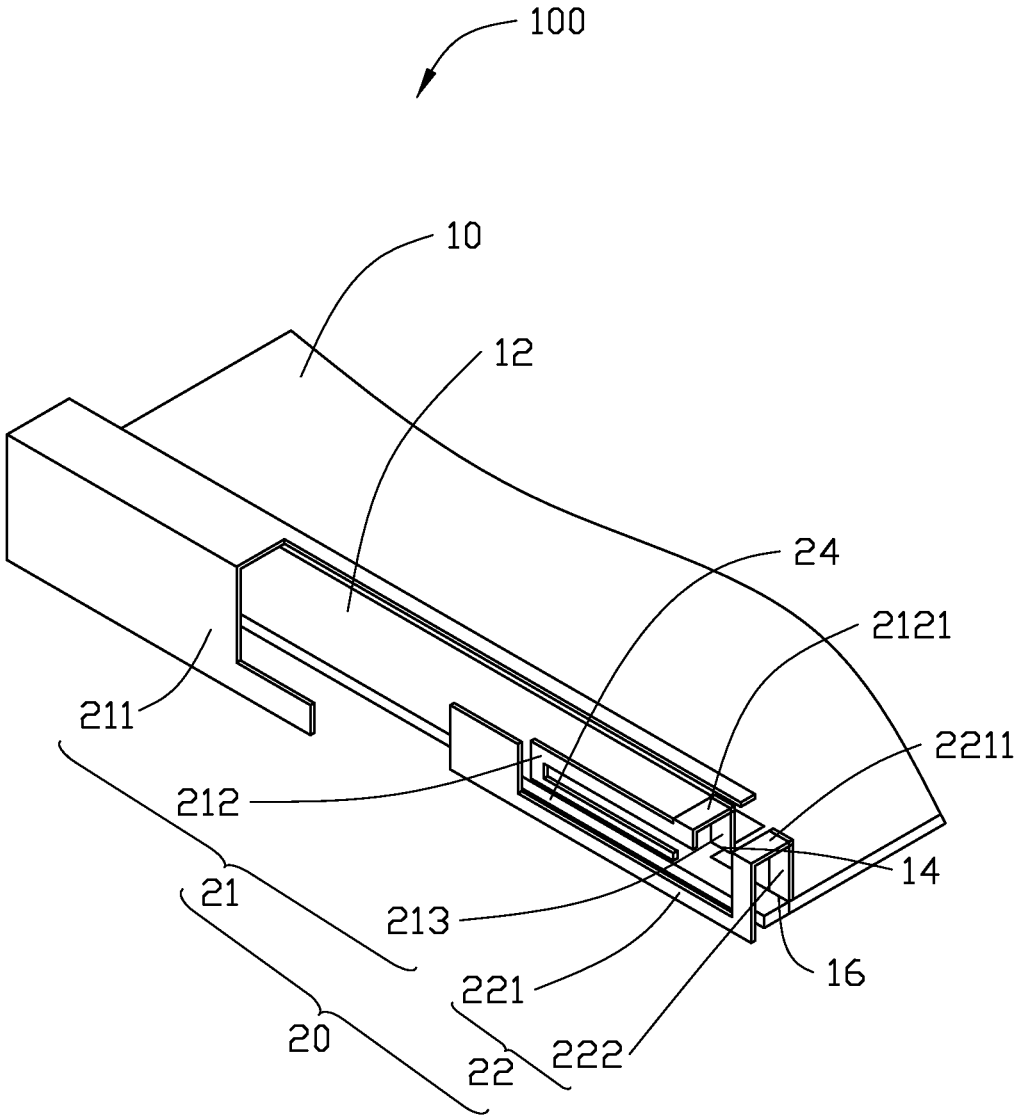
FIG. 1 is an isometric view of one embodiment of a wireless communication device employing an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" when utilized, means "including, but not necessarily limited to"; it specifically indicates open-ended inclusion or membership in the so-described combination, group, series and the like.

FIG. 1 illustrates an isometric view of one embodiment of a wireless communication device 100 employing a substrate 10 and an antenna structure 20 mounted on the substrate 10. The substrate 10 includes a dielectric clearance region 12, a feeing point 14 and a grounding point 16 (also see FIGS. 2-3). The dielectric clearance region 12 is defined at one end of the substrate 10 for mount the antenna structure 20. The feeding point 14 is defined in the dielectric clearance region 12, and configured to be electronically coupled to a radio frequency circuit (not shown). The grounding point 16 is defined in the dielectric clearance region 12, and configured to be electronically coupled to ground.

The antenna structure 20 includes a monopole antenna 21 and a short parasitic antenna 22. The monopole antenna 21 includes a first radiating body 211, a second radiating body 212, and a feeding portion 213 electronically coupled to the first radiating body 211 and the second radiating body 212. The first radiating body 211 is configured to excite a low-frequency resonating mode. The second radiating body 212 is configured to excite a first high-frequency resonating mode. The short parasitic antenna 22 includes a parasitic body 221 spaced from the second radiating body 212, and a grounding portion 222 coupled to the parasitic body 221. The short parasitic antenna 22 is configured to excite a second high-frequency resonating mode, and resonate with the second radiating body 212 to excite a third high-frequency resonating mode.

A first current path defined by the first radiating body 211 is longer than a second current path defined by the second radiating body 212. The parasitic body 221 partially surrounds the second radiating body 212.

Figure 2:
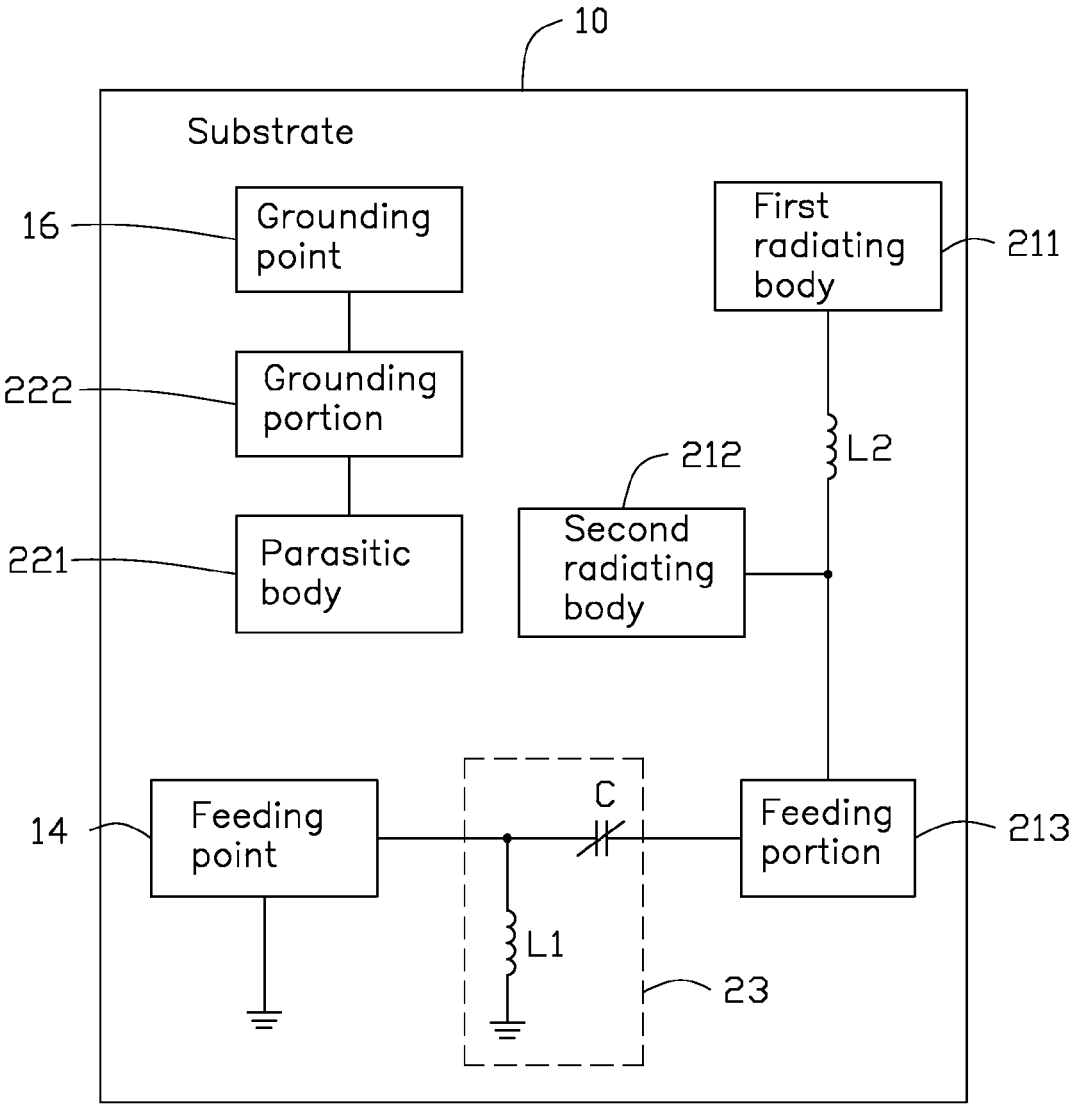
FIG. 2 is a block diagram of the wireless communication device 100 as shown in FIG. 1.

FIG. 2 illustrates a block diagram of the wireless communication device 100 as shown in FIG. 1. As illustrated, the antenna structure 20 further includes an impedance matching circuit 23 electronically coupled between the feeding point 14 and the feeding portion 213. The impedance matching circuit 23 includes a variable capacitor C configured to regulate operating frequency band of the low-frequency resonating mode.

The impedance matching circuit 23 further includes an inductor L1. The variable capacitor C is electronically coupled between the feeding portion 213 and the feeding point 14. The inductor L1 is electronically coupled between ground and a node between the variable capacitor C and the feeding point 14. In one embodiment, an inductance value of the inductor L1 is about 15 nH.

The variable capacitor C can be a digital tuned capacitor that is an integrated circuit capacitor, such as a variable capacitor based on micro-electro-mechanical systems (MEMS) technology. In another embodiment, the variable capacitor 70 is a capacitance-variable diode of which the capacitance value can be changed by changing an applied voltage. In another embodiment, the variable capacitor C can include a plurality of parallel capacitors with different capacitance values and a switch configured to selectively couple one of the capacitors between the feeding portion 213 and the feeding point 14. A range of the capacitor C can be set from about 1.5 pF to about 8 pF.

An inductor L2 is also included that is electronically coupled between the first radiation body 211 and the feeding portion 213. In other words, the second radiation body 212 is electronically coupled to a node between the feeding portion 213 and the inductor L2. By this arrangement, the inductor L2 can isolate the first radiating body 211 from the second radiating body 212, such that the high-frequency resonating modes resonated by the second radiating body 212 can be prevent from the interference of the first radiating body 211. In addition, the inductor L2 can optimize the impedance matching of the antenna structure 20. In one embodiment, an inductance of the inductor L2 is about 7 nH.

As illustrated in FIG. 2, the parasitic body 221 is electronically coupled to the grounding point 16 via the grounding portion 222.

Figure 3:
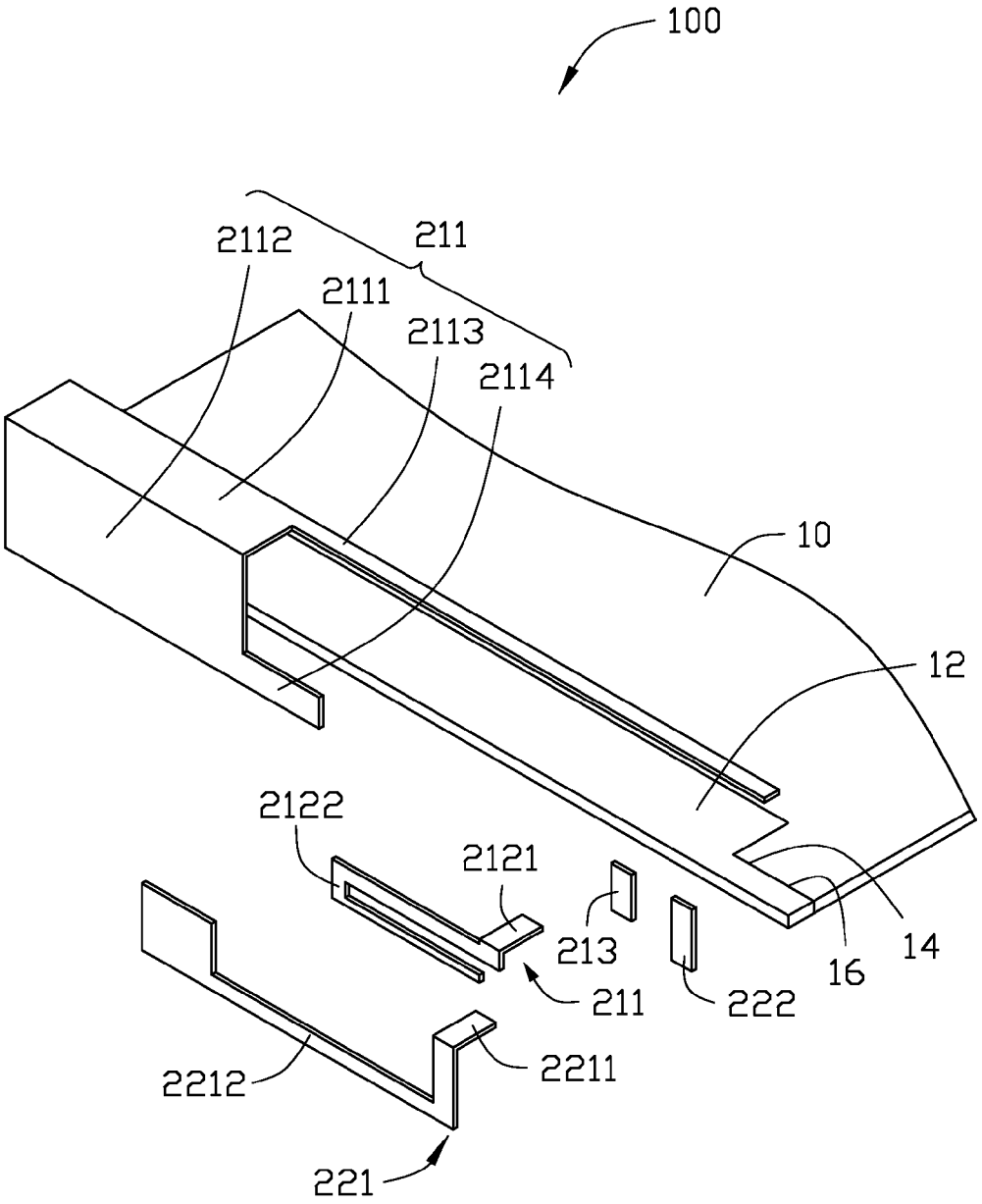
FIG. 3 is an exploded isometric view of the wireless communication device as shown in FIG. 1.

FIG. 3 illustrates an exploded isometric view of the wireless communication device 100 as shown in FIG. 1. The feeding portion 213 and grounding portion 222 are rectangular strips, and are positioned parallel to each other and perpendicular to the substrate 10 (also see FIG. 1).

The first radiating body 211 includes a first arm 2111, a second arm 2112, a third arm 2113, and a fourth arm 2114. The first arm 2111 is substantially perpendicular to the second arm 2112. The third am 2113 extends from one side of the first arm 2111 away from the second arm 2112, and is narrower than the first arm 2111. An end of the third arm 2113 away from the first arm 2111 is electronically coupled to the feeding portion 213 via the inductor L2 (shown in FIG. 2). The fourth arm 2114 extends from one side of the second arm 2112 away from the first arm 2111, and is narrower than the second arm 2112. The first and third arms 2111 and 2113 are positioned in a plane that is substantially perpendicular to a plane in which the second and fourth arms 2112 and 2114 are positioned.

The second radiating body 212 includes a first strip 2121 and a second strip 2122 coupled to the first strip 2121. The first strip 2121 is substantially perpendicularly coupled to the feeding portion 212 as shown in FIG. 1, and is positioned in the plane in which the first and third arms 2111 and 2113 are positioned. The second strip 2122 is substantially U-shaped, and extends from an end of the first arm 2121 facing the second arm 2112. the second strip 2122 is positioned in a plane that is substantially perpendicular to a plane in which the first strip 2121 is positioned.

The parasitic body 221 includes a first section 2211 and a second section 2212 coupled to the first section 2211. The first section 2211 is a substantially rectangular strip, and is substantially perpendicularly coupled to the grounding portion 222 as shown in FIG. 1. The second section 2212 is a meandering strip, and extends from an end of the first section 2211. The second section 2212 partially surrounds the second strip 2122.

In one embodiment, the grounding portion 222 is longer than the feeding portion 213, such that the first strip 2121 and the first section 2211 are positioned in two parallel planes respectively. In addition, the first section 2211 is longer than the first strip 2121, such that the second section 2212 and the second strip 2122 are positioned in two parallel planes respectively. By changing a distance 24 (shown in FIG. 1) between the second section 2212 and the second strip 2122, the impedance matching and bandwidth of the antenna structure 30 can be regulated.

Figure 4:
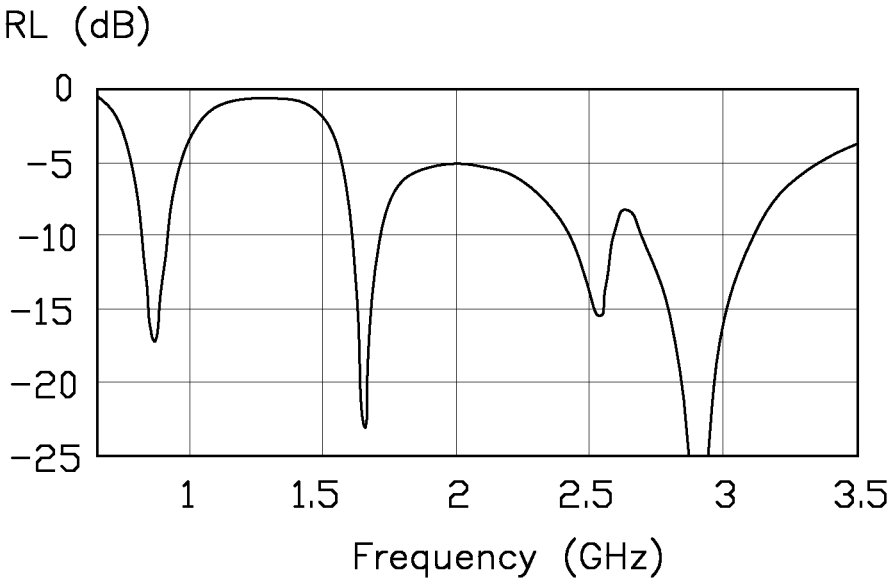
FIG. 4 is a return loss (RL) measurement of the antenna structure of FIG. 1 when a capacitance value of a variable capacitor is set to 2.6 pF.

FIG. 4 illustrates a return loss (RL) measurement of the antenna structure 20 shown in FIG. 1 when a capacitance value of the variable capacitor C is set to 2.6 pF. In use, when current signals are fed to the feeding point 14, the first radiating body 211 excites a low-frequency resonating mode to receive/send wireless signals at a central frequency of about 900 MHz; the second radiating body 212 excites a first high-frequency resonating mode to receive/send wireless signals at a central frequency of about 1700 MHz; the short parasitic antenna 22 excites a second high-frequency resonating mode to receive/send wireless signals at a central frequency of about 2510 MHz; and the short parasitic antenna 22 further resonates with the second radiating body 212 to excite a third high-frequency resonating mode to receive/send wireless signals at a central frequency of about 2900 MHz. It can be derived from FIG. 4 that the RL of the antenna structure 20 is lower than −5 dB when the antenna structure 20 operates at frequency bands of from about 825 MHz to about 960 MHz, and from about 1710 MHz to about 2690 MHz.

Figure 5:
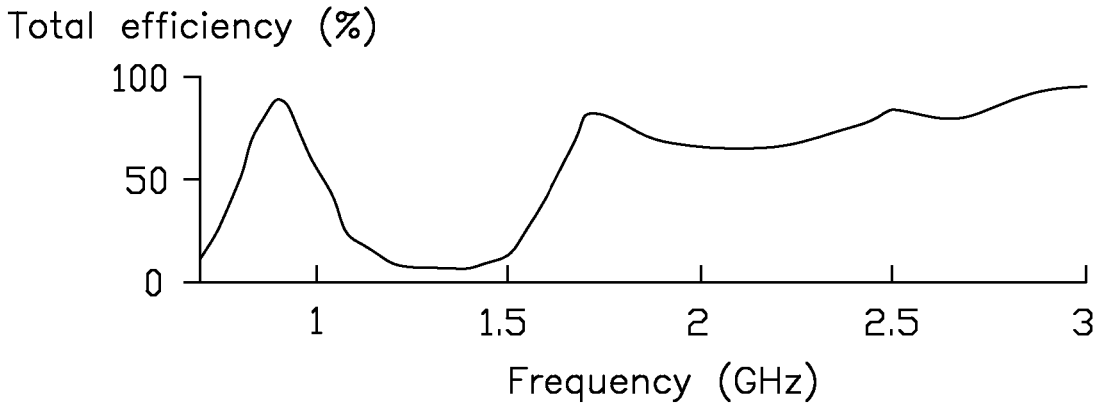
FIG. 5 is a total efficiency measurement of the antenna structure of FIG. 1 when the capacitance value of the variable capacitor is set to 2.6 pF.

FIG. 5 illustrates total efficiency measurement of the antenna structure 20 shown in FIG. 1 when the capacitance value of the variable capacitor C is set to 2.6 pF. The total efficiency of the antenna structure 20 is from about 65% to about 70% when the antenna structure 20 operates at the low-frequency band of from about 825 MHz to about 960 MHz. The total efficiency of the antenna structure 20 is from about 65.8% to about 83.5% when the antenna structure 20 operates at the high-frequency band of from about 1710 MHz to about 2690 MHz.

Figure 6:
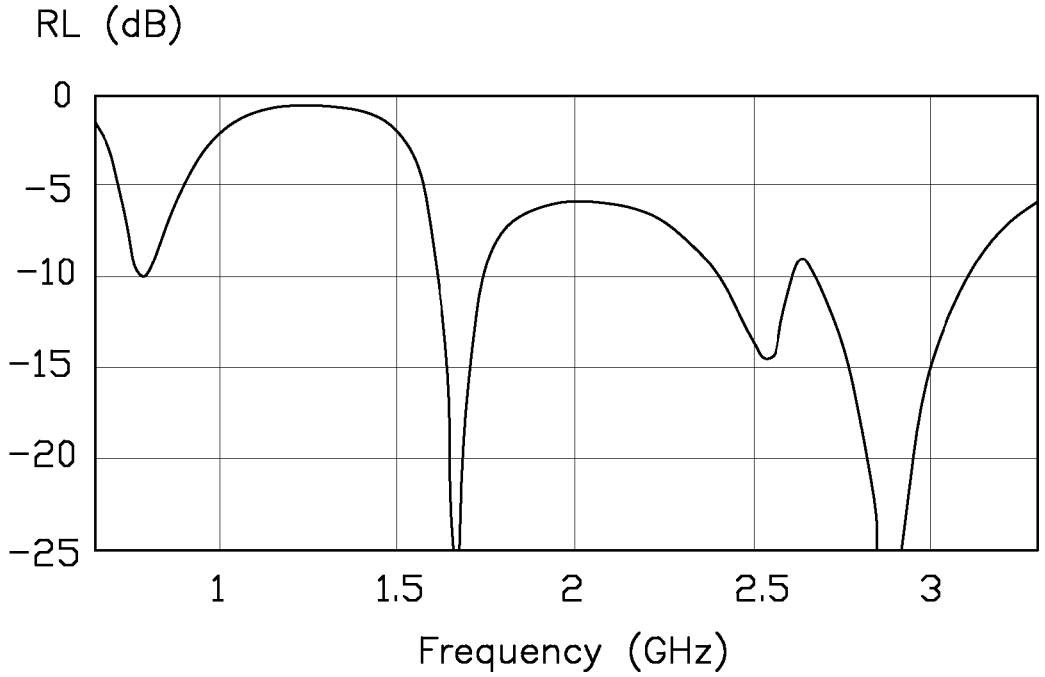
FIG. 6 is a return loss RL measurement of the antenna structure of FIG. 1 when the capacitance value of the variable capacitor is set to 7 pF.

FIG. 6 illustrates a RL measurement of the antenna structure 20 shown in FIG. 1 when the capacitance value of the variable capacitor C is set to 7 pF. In use, when current signals are fed to the feeding point 14, the first radiating body 211 excites a low-frequency resonating mode to receive/send wireless signals at a central frequency of about 700 MHz; the second radiating body 212 excites a first high-frequency resonating mode to receive/send wireless signals at a central frequency of about 1700 MHz; the short parasitic antenna 22 excites a second high-frequency resonating mode to receive/send wireless signals at a central frequency of about 2510 MHz; and the short parasitic antenna 22 further resonates with the second radiating body 212 to excite a third high-frequency resonating mode to receive/send wireless signals at a central frequency of about 2900 MHz. It can be derived from FIG. 4 that the RL of the antenna structure 20 is lower than −5 dB when the antenna structure 20 operates at frequency bands of from about 704 MHz to about 746 MHz, and from about 1710 MHz to about 2690 MHz.

Figure 7:
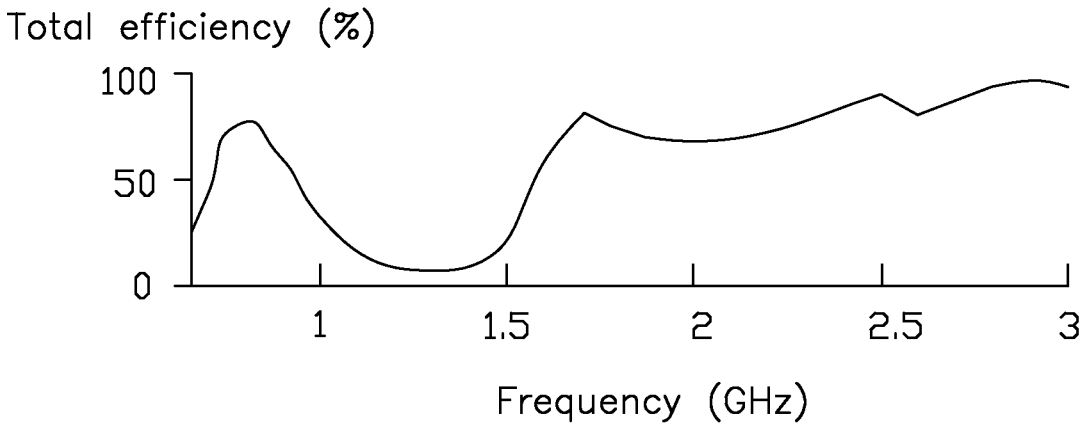
FIG. 7 is a total efficiency measurement of the antenna structure of FIG. 1 when the capacitance value of the variable capacitor is set to 7 pF.

FIG. 7 illustrates a total efficiency measurement of the antenna structure 20 shown in FIG. 1 when the capacitance value of the variable capacitor C is set to 7 pF. The total efficiency of the antenna structure 20 is from about 44% to about 72% when the antenna structure 20 operates at the low-frequency band of from about 704 MHz to about 746 MHz. The total efficiency of the antenna structure 20 is from about 69% to about 89.1% when the antenna structure 20 operates at the high-frequency band of from about 1710 MHz to about 2690 MHz.

Therefore, the antenna structure 20 and the wireless communication device 100 employing the antenna structure 20 can be utilized in common wireless communication systems, such as such as LTE Band 13/17 (700 MHz), GSM (850/900 MHz), GSM (1800-1900 MHz), WCDMA (2100 MHz), LTE Band 1 (2100 MHz), and LTE Band 7 (2600 MHz), with exceptional communication quality.

The embodiments shown and described above are only examples. Many details are often found in the art. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An antenna structure consisting of:

a monopole antenna and a short parasitic antenna;

the monopole antenna comprising a first and second radiating body and a feeding portion;

the feeding portion coupled to the first and second radiating body;

the first radiating body configured to excite a low frequency resonating mode;

the second radiating body configured to excite a first high-frequency resonating mode;

the short parasitic antenna comprising a parasitic body, and a grounding portion;

the parasitic body spaced apart from the second radiating body; and coupled to the grounding portion;

the short parasitic antenna configured to excite a second high-frequency resonating mode;

the short parasitic antenna further configured to resonate with the second radiating body to excite a third high-frequency resonating mode; and an impedance matching circuit electronically coupled to the feeding portion and comprising a variable capacitor;

the variable capacitor configured to regulate operation of the low-frequency resonating mode;

an inductor electronically coupled between the first radiation body and the feeding portion;

wherein a first current path defined by the first radiating body is longer than a second current path defined by the second radiating body; the parasitic body partially surrounds the second radiating body;

wherein the first radiating body comprises a first arm, a second arm, a third arm, and a fourth arm; the first arm is substantially perpendicular to the second arm; the third am extends from one side of the first arm away from the second arm, and is narrower than the first arm; an end of the third arm away from the first arm is electronically coupled to the feeding portion; the fourth arm extends from one side of the second arm away from the first arm, and is narrower than the second arm, the first arm and third arm are positioned in a plane that is substantially perpendicular to a plane in which the second arm and fourth arm are positioned;

wherein the second radiating body comprises a first strip and a second strip coupled to the first strip; the first strip is substantially perpendicularly coupled to the feeding portion; the second strip is substantially U-shaped, and extends from an end of the first arm; the second strip is positioned in a plane that is substantially perpendicular to a plane in which the first strip is positioned;

wherein the parasitic body comprises a first section and a second section coupled to the first section; the first section is a substantially rectangular strip, and is substantially perpendicularly coupled to the grounding portion; the second section is a meandering strip, and extends from an end of the first section; the second section partially surrounds the second strip.

2. The antenna structure of claim 1, wherein the impedance matching circuit further comprises an inductor, the variable capacitor is electronically coupled between the feeding portion and a feeding point; the inductor is electronically coupled between ground and a node between the variable capacitor and the feeding point.

3. An antenna structure comprising:

a monopole antenna comprising a first radiating body, a second radiating body and a feeding portion coupled to the first radiating body and the second radiating body; the first radiating body configured to excite a low-frequency resonating mode; the second radiating body configured to excite a first high-frequency resonating mode; and a short parasitic antenna comprising a parasitic body and a grounding portion coupled to the parasitic body; the parasitic body positioned spaced from and partially surrounding the second radiating body; the short parasitic antenna configured to excite a second high-frequency resonating mode, and resonate with the second radiating body to excite a third high-frequency resonating mode; and an impedance matching circuit electronically coupled to the feeding portion and comprising a variable capacitor;

the variable capacitor configured to regulate operation of the low-frequency resonating mode;

wherein a first current path defined by the first radiating body is longer than a second current path defined by the second radiating body; the parasitic body partially surrounds the second radiating body;

wherein the first radiating body comprises a first arm, a second arm, a third arm, and a fourth arm; the first arm is substantially perpendicular to the second arm; the third am extends from one side of the first arm away from the second arm, and is narrower than the first arm; an end of the third arm away from the first arm is electronically coupled to the feeding portion; the fourth arm extends from one side of the second arm away from the first arm, and is narrower than the second arm, the first arm and third arm are positioned in a plane that is substantially perpendicular to a plane in which the second arm and fourth arm are positioned;

wherein the second radiating body comprises a first strip and a second strip coupled to the first strip; the first strip is substantially perpendicularly coupled to the feeding portion; the second strip is substantially U-shaped, and extends from an end of the first arm; the second strip is positioned in a plane that is substantially perpendicular to a plane in which the first strip is positioned;

wherein the parasitic body comprises a first section and a second section coupled to the first section; the first section is a substantially rectangular strip, and is substantially perpendicularly coupled to the grounding portion; the second section is a meandering strip, and extends from an end of the first section; the second section partially surrounds the second strip.

4. The antenna structure of claim 3, wherein the impedance matching circuit further comprises an inductor; the variable capacitor is electronically coupled between the feeding portion and a feeding point; the inductor is electronically coupled between ground and a node between the variable capacitor and the feeding point.

5. The antenna structure of claim 3, further comprising an inductor electronically coupled between the first radiation body and the feeding portion.

6. A wireless communication device comprising:

a substrate comprising a grounding point and a feeding point;

an antenna structure comprising:

a monopole antenna comprising a first radiating body, a second radiating body and a feeding portion coupled to the first radiating body and the second radiating body; the feeding configured to electronically coupled to the feeding point to feed current signals; the first radiating body configured to excite a low-frequency resonating mode; the second radiating body configured to excite a first high-frequency resonating mode; and a short parasitic antenna comprising a parasitic body and a grounding portion coupled to the parasitic body; the parasitic body positioned spaced from and partially surrounding the second radiating body; the grounding portion is configured to electronically coupled to the grounding point; the short parasitic antenna configured to excite a second high-frequency resonating mode, and resonate with the second radiating body to excite a third high-frequency resonating mode; and an impedance matching circuit electronically coupled to the feeding portion and comprising a variable capacitor;

the variable capacitor configured to regulate operation of the low-frequency resonating mode;

wherein a first current path defined by the first radiating body is longer than a second current path defined by the second radiating body; the parasitic body partially surrounds the second radiating body;

wherein the first radiating body comprises a first arm, a second arm, a third arm, and a fourth arm; the first arm is substantially perpendicular to the second arm; the third am extends from one side of the first arm away from the second arm, and is narrower than the first arm; an end of the third arm away from the first arm is electronically coupled to the feeding portion; the fourth arm extends from one side of the second arm away from the first arm, and is narrower than the second arm, the first arm and third arm are positioned in a plane that is substantially perpendicular to a plane in which the second arm and fourth arm are positioned;

wherein the second radiating body comprises a first strip and a second strip coupled to the first strip; the first strip is substantially perpendicularly coupled to the feeding portion; the second strip is substantially U-shaped, and extends from an end of the first arm; the second strip is positioned in a plane that is substantially perpendicular to a plane in which the first strip is positioned;

wherein the parasitic body comprises a first section and a second section coupled to the first section; the first section is a substantially rectangular strip, and is substantially perpendicularly coupled to the grounding portion; the second section is a meandering strip, and extends from an end of the first section; the second section partially surrounds the second strip.

7. The wireless communication device of claim 6, wherein the impedance matching circuit further comprises an inductor; the variable capacitor is electronically coupled between the feeding portion and a feeding point; the inductor is electronically coupled between ground and a node between the variable capacitor and the feeding point.

* * * * *